US008209805B2

(12) United States Patent
Park

(10) Patent No.: US 8,209,805 B2
(45) Date of Patent: Jul. 3, 2012

(54) OPERATING METHOD IN WASHING MACHINE

(75) Inventor: Seog Kyu Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 999 days.

(21) Appl. No.: 11/629,661

(22) PCT Filed: Mar. 24, 2006

(86) PCT No.: PCT/KR2006/001102

§ 371 (c)(1),
(2), (4) Date: Aug. 17, 2007

(87) PCT Pub. No.: WO2006/101376

PCT Pub. Date: Sep. 28, 2006

(65) Prior Publication Data

US 2008/0115293 A1 May 22, 2008

(30) Foreign Application Priority Data

Mar. 25, 2005 (KR) ..... 10-2005-0025131

(51) Int. Cl.
*D06F 35/00* (2006.01)
*D06F 39/04* (2006.01)

(52) U.S. Cl. ..... 8/149.3; 8/149.1; 8/149.2; 68/3 R; 68/5 C; 68/5 R; 68/12.05; 68/12.21

(58) Field of Classification Search ..... 8/149.1, 8/149.2, 149.3, 158, 159; 68/3 R, 5 C, 5 R, 68/12.05, 12.21
See application file for complete search history.

(56) References Cited

U.S. PATENT DOCUMENTS

| | | | | |
|---|---|---|---|---|
| 5,394,582 | A | 3/1995 | Moon | |
| 6,255,952 | B1 * | 7/2001 | Jang | 340/588 |
| 2004/0035465 | A1 * | 2/2004 | Cazden | 137/392 |
| 2004/0187527 | A1 | 9/2004 | Kim et al. | |
| 2004/0226934 | A1 * | 11/2004 | Moore et al. | 219/401 |
| 2004/0255391 | A1 * | 12/2004 | Kim et al. | 8/149.3 |
| 2006/0191077 | A1 * | 8/2006 | Oh et al. | 8/158 |

FOREIGN PATENT DOCUMENTS

| | | |
|---|---|---|
| CN | 1075993 | 9/1993 |
| CN | 1534128 | 10/2004 |
| DE | 42 35 194 A1 | 4/1993 |
| EP | 1 507 031 A1 | 2/2005 |
| EP | 1 696 067 A1 | 8/2006 |

* cited by examiner

*Primary Examiner* — Michael Barr
*Assistant Examiner* — Benjamin Osterhout
(74) *Attorney, Agent, or Firm* — McKenna Long & Aldridge LLP

(57) ABSTRACT

An object of the present invention is to provide a washing method of a washing machine, in which an out of order of a water level sensor in a steam generator which generates steam is detected exactly, for safe protection of the steam generator and laundry, and effective performance of the washing. To achieve the object of the present invention, the washing method includes the steps of ($ sensing a water level sensor being out of order during steam washing, and (B) turning off the' steam generator if it is sensed that the water level sensor is out of order.

14 Claims, 4 Drawing Sheets

[Fig. 1]
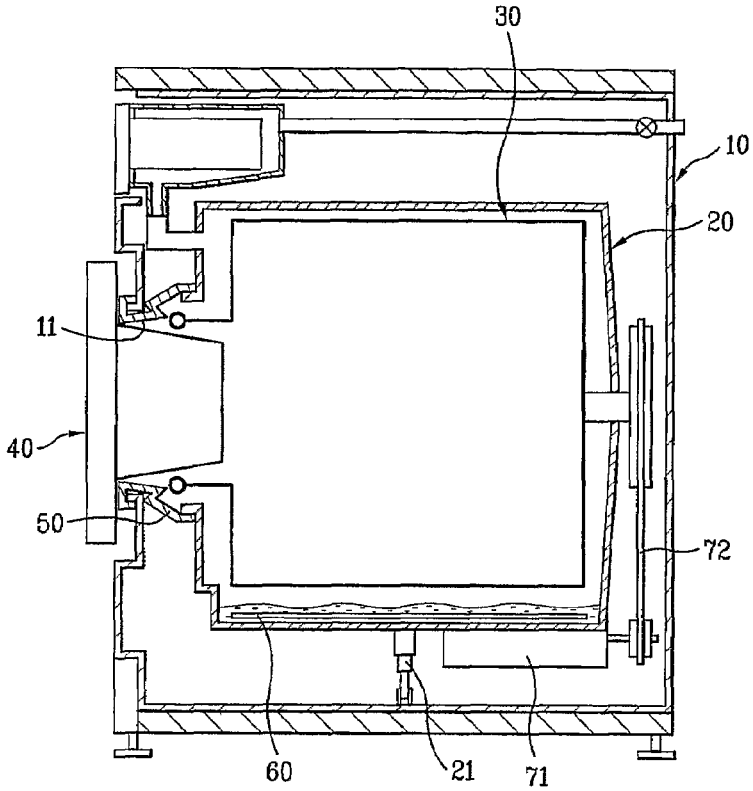
[Fig. 2]
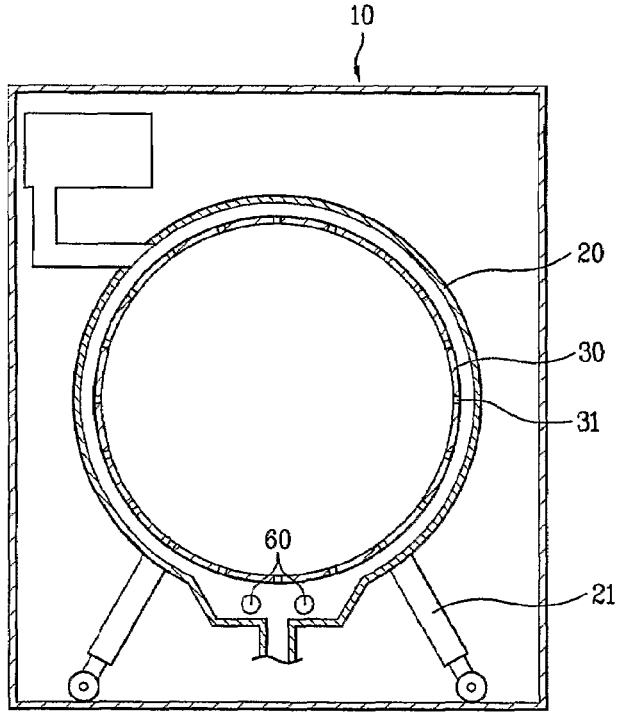

[Fig. 3]
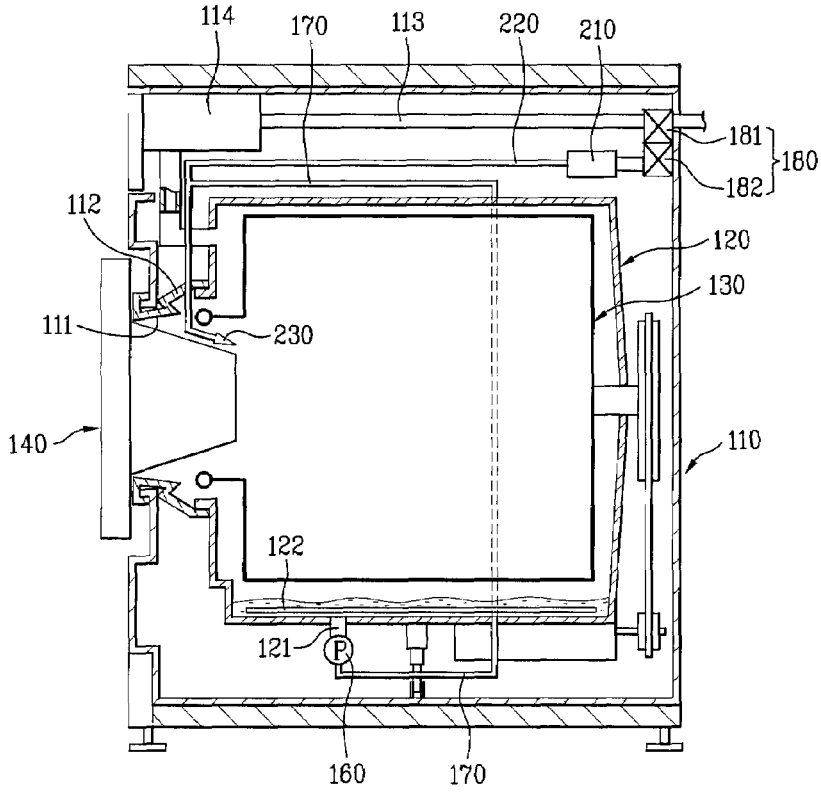
[Fig. 4]
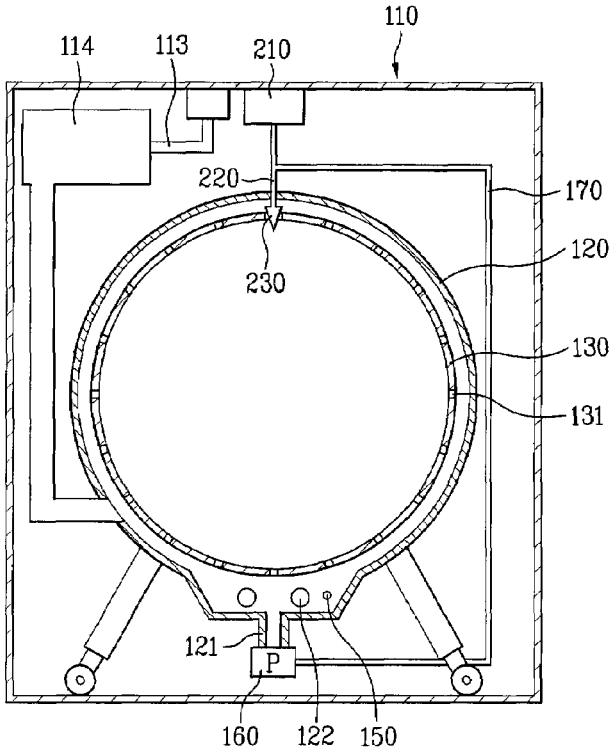

[Fig. 5]
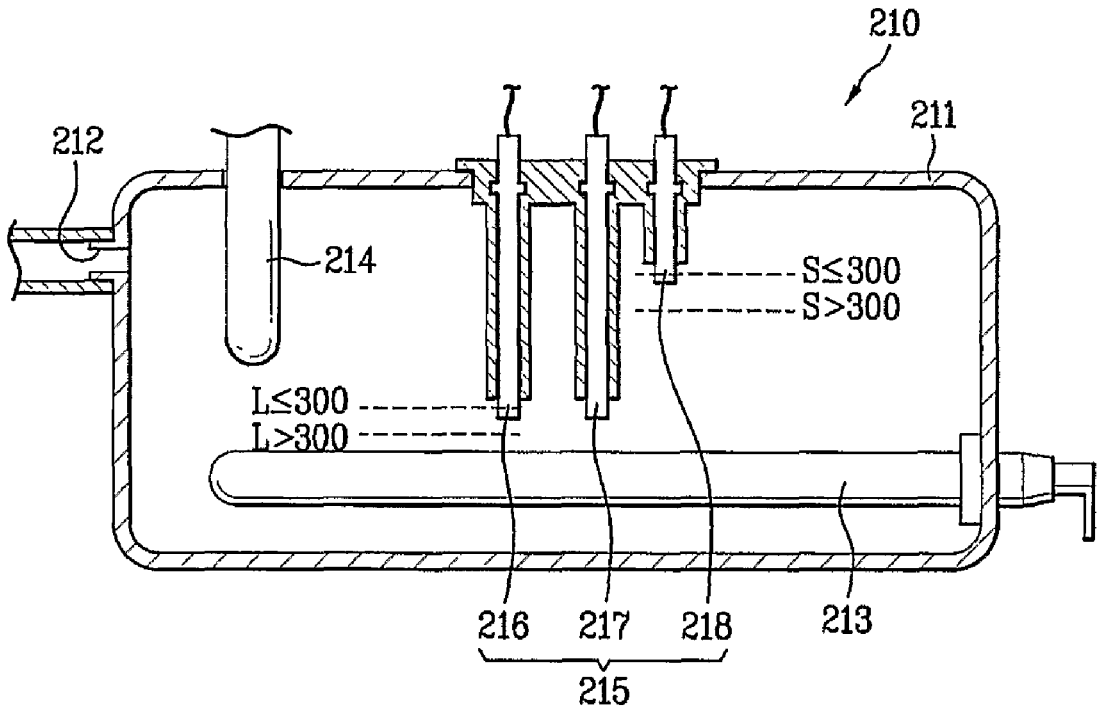

[Fig. 6]
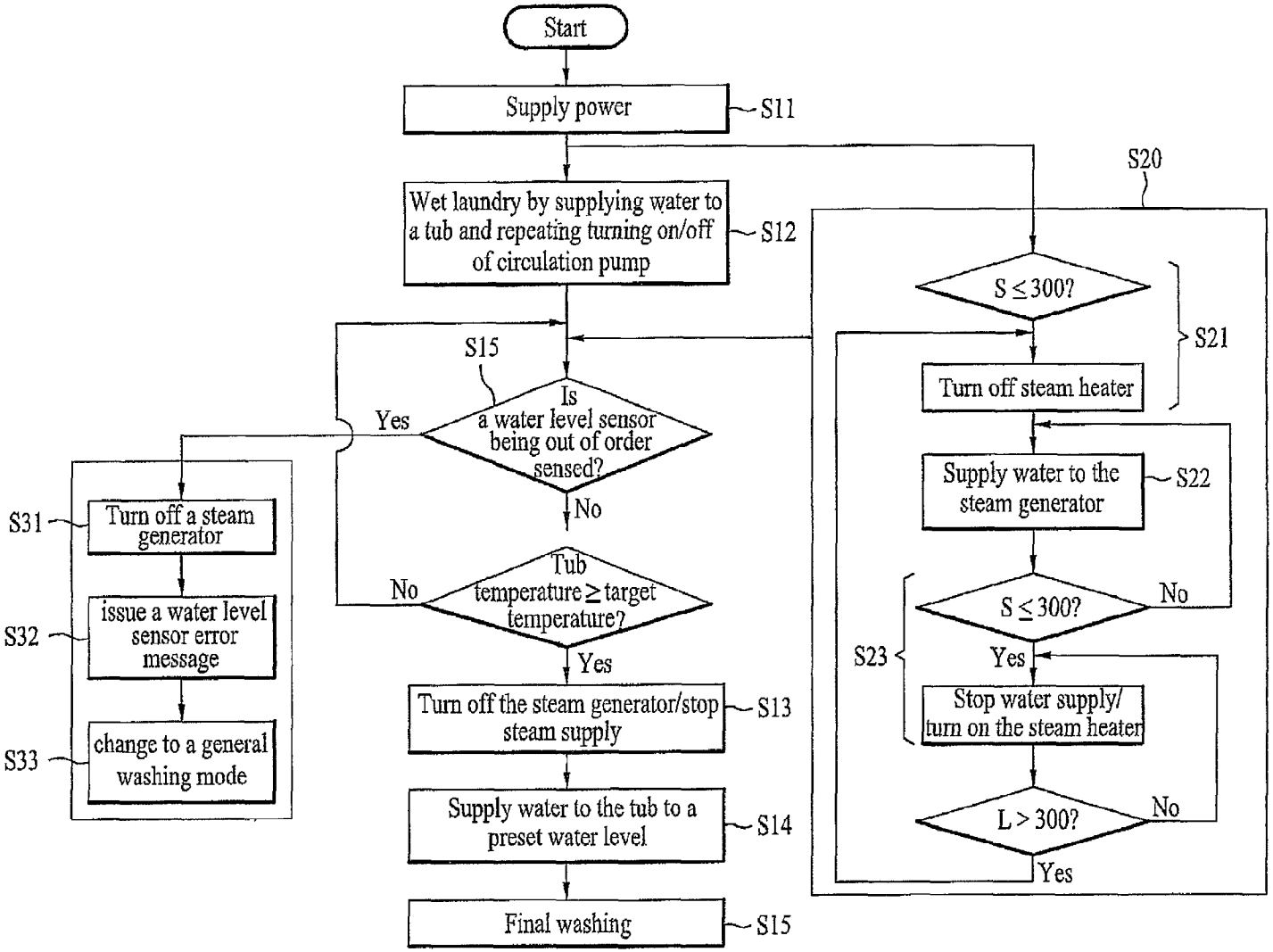

OPERATING METHOD IN WASHING MACHINE

This application claims priority to International application No. PCT/KR2006/001102 filed on Mar. 24, 2006 and Korean Application No. 10-2005-0025131, filed on Mar. 25, 2005, which incorporated by reference, as if fully set forth herein.

TECHNICAL FIELD

The present invention relates to a method for operating a washing machine, and more particularly, to a washing method of a washing machine which can wash laundry by using steam.

BACKGROUND ART

In general, in the washing machines, there are pulsator type washing machines each having an upright drum and drum type washing machines each having a drum laid down in a horizontal direction.

As described, since the drum type washing machine has the drum laid down in a horizontal direction, the drum type washing machine washes laundry introduced to the drum by dropping the laundry.

FIGS. 1 and 2 each illustrates a related art drum type washing machine, schematically.

Referring to FIGS. 1 and 2, the related art drum type washing machine is provided with a body 10, a tub 20 in the body 10, a drum 30 rotatably mounted in the tub 20, and driving means for driving the drum 30.

The body 10 has a laundry opening 11 in a front for introduction of the laundry, with a door 40 on the laundry opening 11 for opening/closing the laundry opening.

Together with this, there is a gasket 50 on an inside circumference of the laundry opening 11 for sealing a gap between the door 40 and the laundry opening 11.

The tub 20 is provided with dampers 21 on a lower side of an outside circumference for being supported within the body 10.

The driving means is provided with a driving motor 71 for driving the drum 30, and a belt 72 for transmission of driving power from the driving motor 71 to the drum 30.

However, the related art washing machine has a problem in that, even if a small amount of laundry and laundry with a low extent of dirt is washed, not only an un-necessary large amount of washing water, but also an unnecessary large amount of power is consumed because the washing process is substantially identical to a general washing process.

Particularly, though soaking of the laundry before the washing is effective for washing, the soaking has been omitted in general washing due to a large amount of washing water consumption, leading to fail to obtain the best washing performance.

Moreover, in the related art washing process, there is no step for sterilizing the laundry.

Of course, as shown in the attached drawing, recently, though there are washing machines each having a heater 60 in the tub 20 for heating the washing water to make boiled washing available, the washing machines each having a heater 60 are failed to attract much interest of the consumers due to large amount of washing water, and power consumption for boiling that is only means for sterilizing the laundry.

Accordingly, recently, a new washing machine is under development; which sprays a high temperature steam into the drum in the washing machine, for improving a washing performance and providing a sterilizing function even with small amounts of washing water and power consumption.

However, if something in a steam generator which is to generate and spray the steam or in other units which supply the washing water to the drum becomes out of order, the related art washing machine having a steam spray function is liable to cause damage to the unit that becomes out of order or units related thereto, or to the laundry by the spraying high temperature steam to stop the washing and impair safety.

DISCLOSURE OF INVENTION

Technical Problem

An object of the present invention is to provide a washing method of a washing machine, in which an out of order of a water level sensor in a steam generator which generates steam is detected exactly, for safe protection of the steam generator and laundry, and effective performance of the washing.

Technical Solution

The object of the present invention can be achieved by providing a washing method of a washing machine including the steps of (A) sensing a water level sensor being out of order during steam washing, and (B) turning off the steam generator if it is sensed that the water level sensor is out of order.

The (A) step includes the step of determining that the water level sensor is out of order if the water level sensor senses a full water level and a zero water level at the same time.

The (A) step further includes the step of determining that the water level sensor is out of order, if a temperature of the steam generator rises higher than a preset temperature within a preset time period when the water level sensor senses the full water level and power is supplied to the steam heater to generate heat.

In this instance, it is preferable that the washing method further includes the step of supplying water to the steam generator for a preset time period for cooling the steam heater after the step (B).

The (A) step further includes the step of determining that the water level sensor is out of order, if the water level sensor fails to sense the full water level until a time starting from water supply to the steam generator.

The (A) step further includes the step of determining that the water level sensor is out of order, if water is supplied to the steam generator excessively, to change a water level of the tub.

The (B) step further includes the step of expressing a message that the water level sensor is out of order to an outside of the washing machine.

Preferably, the washing method further includes the step of changing to a general washing mode after the step (B).

The general washing mode includes the steps of supplying water to the tub up to a preset water level, and rotating the drum in both directions alternately for a preset time period.

The general washing mode further includes the steps of heating the washing water by using the washing water heater until a temperature of the tub rises to a preset temperature.

ADVANTAGEOUS EFFECTS

The washing method of a washing machine of the present invention permits secure washing because the washing method permits to sense the water level sensor which senses a water level of the steam generator being out of order, turn off the steam generator, and change to a general washing mode.

BRIEF DESCRIPTION OF THE DRAWINGS

The accompanying drawings, which are included to provide a further understanding of the invention, illustrate embodiment(s) of the invention and together with the description serve to explain the principle of the invention. In the drawings;

FIG. 1 illustrates a longitudinal section of a related art drum type washing machine;

FIG. 2 illustrates a cross section of a related art drum type washing machine;

FIG. 3 illustrates a longitudinal section of a drum type washing machine in accordance with a preferred embodiment of the present invention;

FIG. 4 illustrates a cross section of a drum type washing machine in accordance with a preferred embodiment of the present invention;

FIG. 5 illustrates a section of key parts of the steam generator of the washing machine in FIG. 3 in accordance with a preferred embodiment of the present invention; and FIG. 6 illustrates a flow chart showing the steps of a washing method of a washing machine in accordance with a preferred embodiment of the present invention.

BEST MODE FOR CARRYING OUT THE INVENTION

Reference will now be made in detail to the preferred embodiments of the present invention, examples of which are illustrated in the accompanying drawings.

FIG. 3 illustrates a longitudinal section of a drum type washing machine in accordance with a preferred embodiment of the present invention, and FIG. 4 illustrates a cross section of a drum type washing machine in accordance with a preferred embodiment of the present invention.

FIG. 5 illustrates a section of key parts of the steam generator of the washing machine in FIG. 3 in accordance with a preferred embodiment of the present invention, and FIG. 6 illustrates a flow chart showing the steps of a washing method of a washing machine in accordance with a preferred embodiment of the present invention.

Referring to FIGS. 3 and 4, the washing machine of the present invention includes a body 110, a tub 120, a drum 130, a steam supply unit, a temperature sensor 150, a circulating pump 160, a circulating flow passage 170, and a water level sensor (not shown) for sensing a water level of washing water in the tub. In the description of the present invention, the drum type washing machine will be taken as an example.

The body 110 forms an exterior of the drum type washing machine, and has a laundry opening 111 in a front.

There is a door 140 on the laundry opening 111 in the body 110 for opening/closing the laundry opening 111, with a gasket 112 on an inside circumference of the laundry opening 111 for sealing between the door 140 and the laundry opening 111.

There is a washing water supply pipe 113 in the body 110 for supplying washing water to the tub 120, with a detergent box 114 mounted thereon.

The tub 120 is mounted in the body 110 in a supported state.

There is a water discharge flow passage 121 connected to a bottom of the tub 120 for draining washing water.

On a bottom of the tub 120, there is a heater 122 for heating the washing water in the tub 120.

The drum 130 is rotatably mounted in the tub 120, with an opening positioned to face the laundry opening 111 in the body 110.

The drum 130 has a plurality of pass through holes 131 for free flow of the washing water and the steam introduced to the tub 120.

There is at least one of the steam supply unit for supplying a predetermined amount of steam to the tub 120 and/or drum 130.

The circulating pump 160 is on the water discharge flow passage 121 connected to the tub 120, for pumping the washing water from the tub 120 for circulating the washing water.

The circulating flow passage 170 is a pipe line connected to the circulating pump 160, for guiding circulation of the washing water pumped by the circulating pump 160.

It is preferable that one end of the circulating flow passage 170 through which the washing water is to be discharged is passed through the gasket 112, and directed toward an inside wall of the drum 130. Though the end of the circulating flow passage 170 may be connected to the steam supply pipe 220 as shown in the drawing attached as one preferred embodiment of the present invention, different from this, the end of the circulating flow passage 170 may be separated from the steam supply pipe 220, and connected to an inside of the drum.

The temperature sensor 150 is mounted to a portion of the tub 120, for sensing a temperature of the tub 120. The temperature sensed by the temperature sensor 150 may be used for controlling operation of the steam supply unit and the washing water heater 122.

In the meantime, unexplained symbol 180 denotes a water supply valve assembly 180 for selective supply of washing water to the detergent box 114 and the steam supply unit from an outside of the washing machine, 181 denotes a washing water supply valve for controlling washing water supply to the tub 120 through the detergent box 114, and 182 denotes a steam generating water supply valve for controlling water supply to the steam generator.

The steam supply unit, for turning water into steam with heat, and supplying the steam to the tub 120 and/or the drum 130, includes a steam generator SG 210 for providing heat to turn the water into steam a steam supply pipe 220 for flow of the steam from the steam generator 210, and a spray nozzle 230 for spraying the steam flowing through the steam supply pipe 220 into the tub and/or the drum 130.

The spray nozzle 230 has a nozzle shape for smooth spray of the steam, preferably with an end through which the steam is to be sprayed is passed through the gasket 112 so that the end is directed toward an inner side of the drum 130.

One preferred embodiment of the steam generator 210 and operation thereof will be described with reference to FIG. 5 in more detail.

The steam generator 210 includes a case 211, a steam heater 213, a steam side temperature sensor 214, and a water level sensor 215. The case 211 is a hexahedral box for forming an exterior of the steam generator and a space for generating the steam. The case 211 has an inlet 212 for receiving water and an outlet (not shown) discharging steam both formed to be in communication with an outside of the steam generator.

The steam heater 213 is in the case 211 for generating heat to vaporize the water in the case 211. The steam heater 213 may be a sheath heater or the like. Though not shown, the steam heater 213 has a fuse therein for cutting off power when the steam heater 213 is overheated to protect the steam generator 210.

The steam side temperature sensor 214 is electrically connected to a controller of the washing machine, for sensing an inside temperature of the case 211 when the steam heater 213 generates heat.

The water level sensor 215 has three electrodes of a common electrode 216, a long electrode 217, and a short electrode 218, for sensing a water level in the case 211. The water level sensor 215 is electrically connected to a controller (not shown) which controls all operation of units of the washing machine, such as the water supply valve assembly 180, the steam heater 213, and so on.

Both the common electrode 216 and the long electrode 217 are formed such that terminals thereof are exposed at a height preset as a lowest water level of water required for generating steam substantially, and the short electrode 218 is formed shorter than the common electrode 216 and the long electrode 217 such that a terminal thereof is exposed at a height preset as a highest water level of water required for generating steam substantially.

It is preferable that the height at which both the common electrode 216 and the long electrode 217 are exposed is a height enough to submerge the steam heater 213 under the water, completely.

The controller (not shown) of the washing machine has an A/D converter (ADC; Analog-digital converter) (not shown) for receiving and converting a sensed value at the water level sensor 215 into a digital value, for comparing a digital data value (hereafter called as "a converted value") converted by the A/D converter to a preset reference value to control operation of the steam generating water supply valve 182 of the water supply valve assembly 180, and heat generation of the steam heater 213.

For an example, before the water supplied to the steam generator 210 reaches to the long electrode 217, the converted value (hereafter called as L) of the long electrode 217 exceeds 300, and the converted value (hereafter called as S) of the short electrode 218 also exceeds 300.

Then, if the water supplied to the steam generator 210 reaches to the long electrode 217, the L drops below 300, and if the water supplied to the steam generator 210 reaches to the short electrode 218, the S also drops below 300.

Therefore, sensing that the water is at a full water level if the S drops below 300, the controller (not shown) stops water supply to the steam generator 210, turns on the steam heater 213 to generate heat, turns off the steam heater 213 to stop the heat generation if the L exceeds 300 sensing that the water level is at zero, and supplies water to the steam generator 210, again. As described before, the water supply to the steam generator 210 is made by controlling the steam generating water supply valve 182 (see FIG. 3).

The steam generator 210 supplies steam to the drum by repeating turning on/off of the water supply and the steam heater 213 while keeping sensing the water level with the water level sensor 215.

A washing method of the foregoing drum type washing, machine in accordance with a preferred embodiment of the present invention will be described in detail with reference to the flow chart in FIG. 6.

FIG. 6 illustrates a flow chart showing all the steps of a washing method of a washing machine in accordance with a preferred embodiment of the present invention, schematically.

Referring to FIG. 6, if power is supplied to the washing machine (S11), a controller (not shown) of the washing machine controls the washing water supply valve 181 of the water supply valve assembly 180, to supply the washing water to a preset water level of a tub 120, puts the circulating pump 160 into operation to circulate the washing water from the tub 120 to an upper side of the drum 130 through an outside of the tub, and at the same time with this, rotates the drum 130, to perform wetting of the laundry (S12).

In this instance, the controller controls the steam generating water supply valve 182 of the water supply valve assembly 180, to supply a predetermined amount of water to the steam generator 210, too. Then, as described before, while sensing the water level supplied to the steam generator 210 with the water level sensor 215, the controller controls heat generation of the steam heater 213 and the steam generating water supply valve 182 to supply steam to the drum 130 (S20).

This will be described in more detail. If the converted value S of the short electrode 218 of the water level sensor 215 exceeds 300 after the power supply, water is supplied to the steam generator 210 in a state no power is applied to the steam heater 213 (S21, and S22).

Then, if the converted value S of the short electrode 218 is below 300, that is, if the water is full, the water supply is stopped, and power is supplied to the steam heater 213, to generate heat, and supply steam (S23).

Thus, if the steam generator 210 heats water to generate steam the water level is reduced gradually. Accordingly, if the water level in the steam generator 210 is reduced such that the converted value L of the long electrode 217 exceeds 300, sensing that the water level is zero, the controller turns off power to the steam heater 213 of the steam generator 210 (S21), and opens the steam generating water supply valve 182, to supply water to the steam generator 210 again (S22).

By repeating the foregoing steps, the steam generator 210 supplies steam to the drum 130.

Thus, while the wetting is progressing by the re-supply of water to the tub, the drum rotation, and the driving of the circulating pump 160 (S12), as high temperature steam is sprayed into the drum 130 through the steam generator 210, an inside of the drum 130 becomes to have an environment of a temperature the most effective for washing.

The steps of laundry wetting S12 and the steam supply S20 through the steam generator 210 are performed until the temperature sensed at the temperature sensor 150 reaches to a target temperature T.

If the temperature sensed at the temperature sensor 150 reaches to the target temperature T, steam supply through the steam generator 210 is stopped (S13), the washing water supply valve 181 is opened to supply water to the tub 120 to a preset water level (S14), and a final washing is performed according to a preset program while rotating the drum 130 in clockwise/anti-clockwise direction (S15). In the final washing, the washing may be performed with washing water in the tub 120 heated to a predetermined temperature by the washing water heater 122, or circulating the washing water by driving the circulating pump 160 for a preset time period.

Once the final washing is finished, selected cycles, such as rinsing, spinning, and so on are performed in succession.

In the meantime, while the laundry wetting and the steam supply is progressing, if the controller senses the water level sensor of the steam generator SG 210 being out of order (S15), the controller forcibly turns off the steam generator 210 even if a tub temperature does not reach to the target temperature yet (S31), issues a water level error message (S32), and turns to a general washing mode, to continue the washing (S33). Of course, a program in the case of out of order may be progressed in a process different from above when the controller senses the water level sensor being out of order.

For an example, even if the controller senses the water level sensor being out of order, the controller may not issue the water level sensor error message, but, after turning off the steam heater 213 of the steam generator 210 and supplying water to the steam generator 210 for a predetermined time period, to cool down the steam heater 213, may perform a general washing mode.

The out of order of the water level sensor 215 may come from a fault of the terminal itself, short circuit, defective contact, or no plugging of the terminal.

Cases the controller of the washing machine senses the water level sensor being out of order, and programs in the case of out of order as countermeasure to the cases will be described in detail.

First, in a case the converted value L of the long electrode 217 is sensed to be greater than 300 during the converted value S of the short electrode 218 sensed at the water level sensor 215 is smaller than 300, i.e., in a case though the short electrode 218 senses as full of water, the long electrode 217 senses as a zero water level, it can be determined that at least one of the short electrode 218 and the long electrode 217 is not in order.

Therefore, since it is liable that the water can be supplied to the steam generator 210 continuously, it is preferable that the steam generating water supply valve 182 is closed, the power to the steam heater 213 is turned off, to stop operation of the steam generator 210, and the operation of the washing machine is converted to a general washing node.

Second, as the converted value S of the short electrode 218 is sensed to be below 300, when power is supplied to the steam heater 213 to generate heat, in a case the temperature of the steam side temperature sensor 214 rises higher than a preset temperature (for an example 100° C.), since it can be determined that only the steam heater 213 generates heat in a state no water is supplied to the steam generator 210 actually, this case is also sensed that the water level sensor 215 is out of order.

Therefore, in this case the steam generating water supply valve 182 is opened to cool down the steam heater 213, and the operation of the washing machine is changed to a general washing mode to proceed the washing.

Third, in a case the converted value S of the short electrode 218 is sensed to be greater than 300 starting from opening of the steam generating water supply valve 182 to a preset time, there can be a case when sensing of water supply is failed due to the short electrode 218 being out of order even if the water is supplied, or a case when no water is supplied actually due a water supply system is out of order even though the short electrode 218 is not out of order.

Therefore, in this case, the water level of the tub 120 is checked, to determine that the water supply system is out of order if the water level of the tub 120 shows no change, and, if there is change of the water level of the tub 120, since it implies that the water supplied to the steam generator 210 is not vaporized, but overflows to the tub 120 continuously, it is determined that the water level sensor 215 is out of order.

In a case that the water level sensor 215 is out of order, the steam generating water supply valve 182 is closed, and the operation of the washing machine is changed to a general washing mode, to proceed the washing.

Of course, besides above cases of sensing the water level sensor being out of order, the out of order of the water level sensor can be sensed by various methods.

It will be apparent to those skilled in the art that various modifications and variations can be made in the present invention without departing from the spirit or scope of the inventions. Thus, it is intended that the present invention covers the modifications and variations of this invention provided they cane within the scope of the appended claims and their equivalents.

Industrial Applicability

The washing method of a washing machine of the present invention has a significantly high industrial applicability because the washing method permits to sense the water level sensor which senses a water level of the steam generator being out of order, turn off the steam generator, and change to a general washing mode.

The invention claimed is:

1. A controlling method of a laundry machine comprising:

turning on a steam heater of a steam generator configured to generate and supply steam to a tub or a drum when a water level sensor senses a predetermined water level of the steam generator, wherein the water level sensor includes electrodes to sense water level of the steam generator;

sensing a malfunction of the water level sensor of the steam generator; and turning off the steam generator when the malfunction of the water level sensor is sensed wherein the malfunction of the water level sensor of the steam generator is sensed:

when the water level sensor senses at least two water levels at substantially the same time; or when a temperature of the steam generator rises higher than a preset temperature within a preset time period after a full water level is sensed by the water level sensor and a steam heater of the steam generator is turned on; or when the water level sensor failed to sense a full water level within a preset time period after a water supply to the steam generator has started.

2. The controlling method as claimed in claim 1, further comprises supplying water to the steam generator for a second preset time period to cool the steam heater after miming off the steam generator.

3. The controlling method as claimed in claim 1, further comprises indicating that the water level sensor is malfunctioning to a user.

4. The controlling method as claimed in claim 1, further comprises changing to a general washing mode after turning off the steam generator.

5. The controlling method as claimed in claim 4, wherein the general washing mode includes:

supplying water to the tub or the drum up to a preset water level; and rotating the drum in both directions alternately for a preset time period.

6. The controlling method as claimed in claim 5, wherein the general washing mode further includes heating the washing water by using a washing water heater until a temperature of the tub or the drum rises to a preset temperature.

7. A laundry machine comprising:

a steam generator including a water level sensor and a steam heater, the steam generator configured to generate and supply steam to a tub or a drum;

a controller to sense a malfunction of the water level sensor; and the controller configured to turn on the steam heater when the water level sensor senses a predetermined water level of the steam generator and to turn off the steam generator when the controller determines that the water level sensor is malfunctioning, wherein the controller changes to a general washing mode after turning off the steam generator and causes a washing water heater to turn on to heat the water instead of the steam generator until a temperature of the tub rises to a preset temperature.

8. The laundry machine as claimed in claim 7, wherein the controller determines that the water level sensor is malfunctioning when the water level sensor senses at least two water levels at the substantially same time.

9. The laundry machine as claimed in claim 7, wherein the controller determines that the water level sensor is malfunctioning when a temperature of the steam generator rises higher than a preset temperature within a first preset time period in which a full water level is sensed by the water level sensor and the steam heater is turned on.

10. The laundry machine as claimed in claim 9, wherein the controller supplies water to the steam generator for a second preset time period to cool the steam heater after turning off the steam generator.

11. The laundry machine as claimed in claim 7, wherein the controller determines that the water level sensor is malfunctioning when the water level sensor fails to sense a full water level within a preset time period after water supply to the steam generator has started.

12. The laundry machine as claimed in claim 7, wherein the controller determines that the water level sensor is malfunctioning when water is supplied to the steam generator excessively such that water overflows from the steam generator and changes a water level of the tub or the drum.

13. The laundry machine as claimed in claim 7, wherein the controller generates an error signal when the controller determines that the water level sensor is malfunctioning.

14. The laundry machine as claimed in claim 7, wherein the general washing mode the controller causes water to be supplied to the tub or the drum up to a preset water level, and the controller causes a drum to be rotated in both directions alternately for a preset time period.

* * * * *